US007427062B2

(12) United States Patent
Jang

(10) Patent No.: US 7,427,062 B2
(45) Date of Patent: Sep. 23, 2008

(54) AUTOMATIC DOCUMENT FEEDER AND IMAGE READING APPARATUS USING THE SAME

(75) Inventor: Heung-kyu Jang, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 103 days.

(21) Appl. No.: 11/493,587

(22) Filed: Jul. 27, 2006

(65) Prior Publication Data

US 2007/0085261 A1 Apr. 19, 2007

(30) Foreign Application Priority Data

Oct. 19, 2005 (KR) ..... 10-2005-0098454

(51) Int. Cl.
*B65H 3/52* (2006.01)

(52) U.S. Cl. ..... 271/124; 271/125

(58) Field of Classification Search ..... 271/124, 271/125

See application file for complete search history.

(56) References Cited

U.S. PATENT DOCUMENTS 5,181,712 A * 1/1993 Perino ..... 271/109

FOREIGN PATENT DOCUMENTS

| | | |
|---|---|---|
| JP | 04-217520 | 8/1992 |
| JP | 04-223935 | 8/1992 |
| JP | 10-017176 | 1/1998 |
| JP | 11-048507 | 2/1999 |
| JP | 11-246060 | 9/1999 |
| JP | 2002-152462 | 5/2002 |
| JP | 2002-265090 | 9/2002 |
| JP | 2004-136999 | 5/2004 |
| JP | 2004-323197 | 11/2004 |

* cited by examiner

*Primary Examiner*—David H Bollinger
(74) *Attorney, Agent, or Firm*—Roylance, Abrams, Berdo & Goodman, L.L.P.

(57) ABSTRACT

An automatic document feeder has a separation roller that separates a document into individual sheets. The document is supplied from a document supply tray. A friction pad is formed to contact one side of the separation roller to supply a friction force for separating the document. A pad holder supports the friction pad. A cover member covers the separation roller. An interlocking unit pressurizes or separates the pad holder toward or from the separation roller in association with an opening or a closing of the cover member. The interlocking unit includes a pinion gear rotating in association with the opening or the closing of the cover member. A rack gear linearly moves in a normal direction of a plane contacting the separation roller and the friction pad according to a rotation direction of the pinion gear. A connecting unit connects the rack gear and the pad holder. An elastic member elastically supports the pad holder to face the separation roller.

21 Claims, 5 Drawing Sheets

AUTOMATIC DOCUMENT FEEDER AND IMAGE READING APPARATUS USING THE SAME

CROSS-REFERENCE TO RELATED APPLICATIONS

This application claims the benefit under 35 U.S.C. § 119 (a) of Korean Patent Application No. 2005-98454 filed Oct. 19, 2005, the entire contents of which are hereby incorporated by reference.

BACKGROUND OF THE INVENTION

1. Field of the Invention

The present invention relates to an automatic document feeder and an image reading apparatus using the same. More particularly, the present invention relates to an automatic document feeder that has an enhanced fixing structure of a friction pad so that a jam may be easily removed, and an image reading apparatus using the same.

2. Description of the Related Art

A multifunctional device having a copying function, such as a copier and a facsimile, employs an automatic document feeder (ADF). Therefore, documents can automatically be fed one sheet at a time and be copied in series without requiring opening and closing of a cover of the copying area when a number of documents are copied so that the time for copying can be significantly reduced.

The automatic document feeder generally has a structure in which an upper cover is opened to remove a document when a jam occurs during the feeding of the document.

Japanese Publication No. 10-017176, the entire disclosure of which is hereby incorporated by reference, discloses an example of the automatic document feeder.

FIG. 1 is a view of an automatic document feeder disclosed in JP 10-017176.

The JP 10-017176 discloses a document conveying part having a roller housing 147*a* in which drive rollers 143*c*', 143*d*' and 143*e*' are disposed and that is rotatable upward around an axis 145*a*. A driven roller 143*d*" is disposed in an upper stream guide 145. A driven roller 143*e*" is disposed in a downstream guide 146. A driven roller 143*c*" is disposed in a cover 148 and is rotatable around an axis 145*a* and has a second rotation region on the upper side.

When the cover 148 is rotated in the first rotation region, only the cover 148 is rotated in the second rotation region, the lock pin 148*f* of the cover 148 is locked in the insertion hole (not shown) of a side plate, and the roller housing 147*a* is rotated upward together with the cover 148.

Japanese Publication No. 2002-265090 discloses another example of the automatic document feeder.

FIG. 2 is a view of a conventional automatic document feeder disclosed in JP 2002-265090, the entire disclosure of which is hereby incorporated by reference.

The JP 2002-265090 discloses an automatic document conveyance device capable of removing jammed paper according to the following process. After opening a main body cover 23 and releasing pressurization of a paper feeding belt 11, a holding member 22 is moved to a release position to press a support member 26 by the holding member 22. The support member 26 is moved in the opposite direction to the direction of pressurization against the energizing force of a coil spring 27.

FIG. 3 is a cross-sectional view of a part of an image reading apparatus having a conventional automatic document feeder.

Referring to FIG. 3, the image reading apparatus includes a document feeding part 110 for automatically feeding a document and an image reading part 130 for reading an image of the fed document.

The document 113 supplied from the document supply tray 111 passes a separation roller 115 to separate into an individual sheet. A friction pad 117 is formed adjacently to an opposed surface of the separation roller 115 to provide a frictional force when the document 113 is separated. The document 113 separated into individual sheets by the separation roller 115 is conveyed via a conveying roller 114 to an image scan unit 131 formed at the image reading part 130. After being conveyed to the image reading unit 131, the document 113 has one side read and is then discharged via a discharge roller 119 so that the image reading process is completed.

The friction pad 117 is supported by a pad holder 121 that is elastically supported by an elastic member 123 toward the separation roller 115. One end of the pad holder 121 is connected with a bottom surface of the document support tray 11.

The reference numeral 125 denotes a cover member capable of opening and closing up and down.

However, in the conventional image reading apparatus, the friction pad 117 is in contact with the separation roller 115 by the elastic member 123. Therefore, when a jam occurs and the document 113 is pulled out in a direction indicated by arrow A, the document 113 may be not removed or torn due to both of the rotation direction of the separation roller 115 and the mutual pressurizing of the separation roller 115 and the friction pad 117.

Accordingly, a need exists for an automatic document feeder having an improved friction pad to facilitate clearing of a paper jam.

SUMMARY OF THE INVENTION

An aspect of the present invention is to provide an automatic document feeder from which a jammed document may be easily removed.

Another aspect of the present invention is to provide an image reading apparatus employing the automatic document feeder.

An automatic document feeder according to a first exemplary embodiment of the present invention includes a separation roller separating a document into individual sheets. The document is supplied from a document supply tray. A friction pad is formed to contact one side of the separation roller to supply a friction force for separating the document. A pad holder supports the friction pad. A cover member covers the separation roller. An interlocking unit pressurizes or separates the pad holder toward or from the separation roller in association with an opening or a closing of the cover member.

The interlocking unit includes a pinion gear rotating in association with the opening or the closing of the cover member. A rack gear linearly moves in a normal direction of a plane contacting the separation roller and the friction pad according to a rotation direction of the pinion gear. A connecting unit connects the rack gear and the pad holder. An elastic member elastically supports the pad holder to face the separation roller.

The pad holder includes a pad supporting part supporting the friction pad. A stem part protrudes from a bottom portion of the pad supporting part.

The connecting unit includes a protruding jaw protruding from one side of the rack gear. A locking jaw protrudes from one side of the stem part to interfere with the protruding jaw.

The elastic member may be a coil spring fitting over an outer circumference of the stem part. The automatic document feeder may further include an elastic member holder supporting the coil spring.

The rack gear may be supported by a supporting shaft and may comprise a slit in which the supporting shaft is inserted and that guides a rectilinear movement of the rack gear.

An image reading apparatus having an automatic document feeding unit according to a second exemplary embodiment of the present invention includes at least one document supply tray supplying a document. A separation roller separates the document supplied from the document supply tray into individual sheets. A friction pad is formed to contact one side of the separation roller to supply a friction force for separating the document. A pad holder supports the friction pad. A cover member covers the separation roller and a portion where the friction pad is formed. An image reading unit reads an image of the document separated into individual sheets and supplied by the separation roller and the friction pad. A conveying roller conveys the document supplied through the automatic document feeding unit toward the image reading unit. An interlocking unit pressurizes or separates the pad holder toward or from the separation roller in association with an opening or a closing of the cover member.

The interlocking unit may include a pinion gear rotating in association with the opening or the closing of the cover member. A rack gear linearly moves in a normal direction of a plane contacting the separation roller and the friction pad according to a rotation direction of the pinion gear. A connecting unit connects the rack gear with the pad holder. An elastic member elastically supports the pad holder to face the separation roller.

The pad holder may include a pad supporting part supporting the friction pad, and a stem part protruding from a bottom portion of the pad supporting part.

The connecting unit may include a protruding jaw protruding from one side of the rack gear, and a locking jaw protruding from one side of the stem part that interferes with the protruding jaw.

The elastic member may be a coil spring fitting over an outer circumference of the stem part. The apparatus may further include an elastic member holder supporting the coil spring.

A conveying path of the document may be formed in a substantially C-shaped path. The document is automatically supplied from the automatic document feeding unit and moved toward the image reading unit.

The document supply tray may be disposed above the image reading unit. The document may be loaded in a face up form on the document supply tray.

Other objects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features and advantages of the present invention will be more apparent from the following detailed description taken with reference to the accompanying drawings, in which.

Throughout the drawings, the same drawing reference numerals will be understood to refer to the same elements, features, and structures.

DETAILED DESCRIPTION OF EXEMPLARY EMBODIMENTS

Exemplary embodiments of the present invention will be described in detail with reference to the annexed drawings. In the following description, detailed descriptions of known functions and configurations incorporated herein have been omitted for conciseness and clarity.

Figure 1:
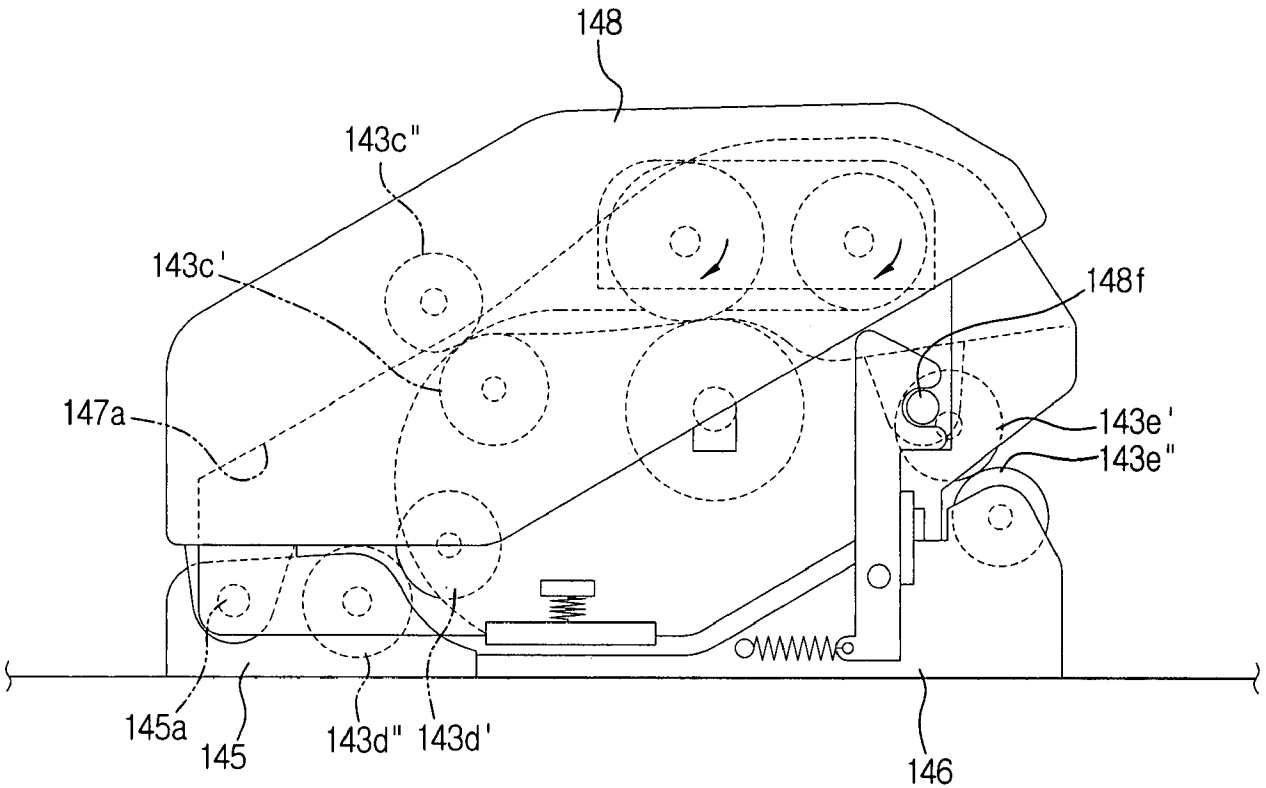
FIG. 1 (PRIOR ART)
FIG. 1 is a schematic view of a conventional automatic document feeder disclosed in JP 10-017176.
Figure 2:
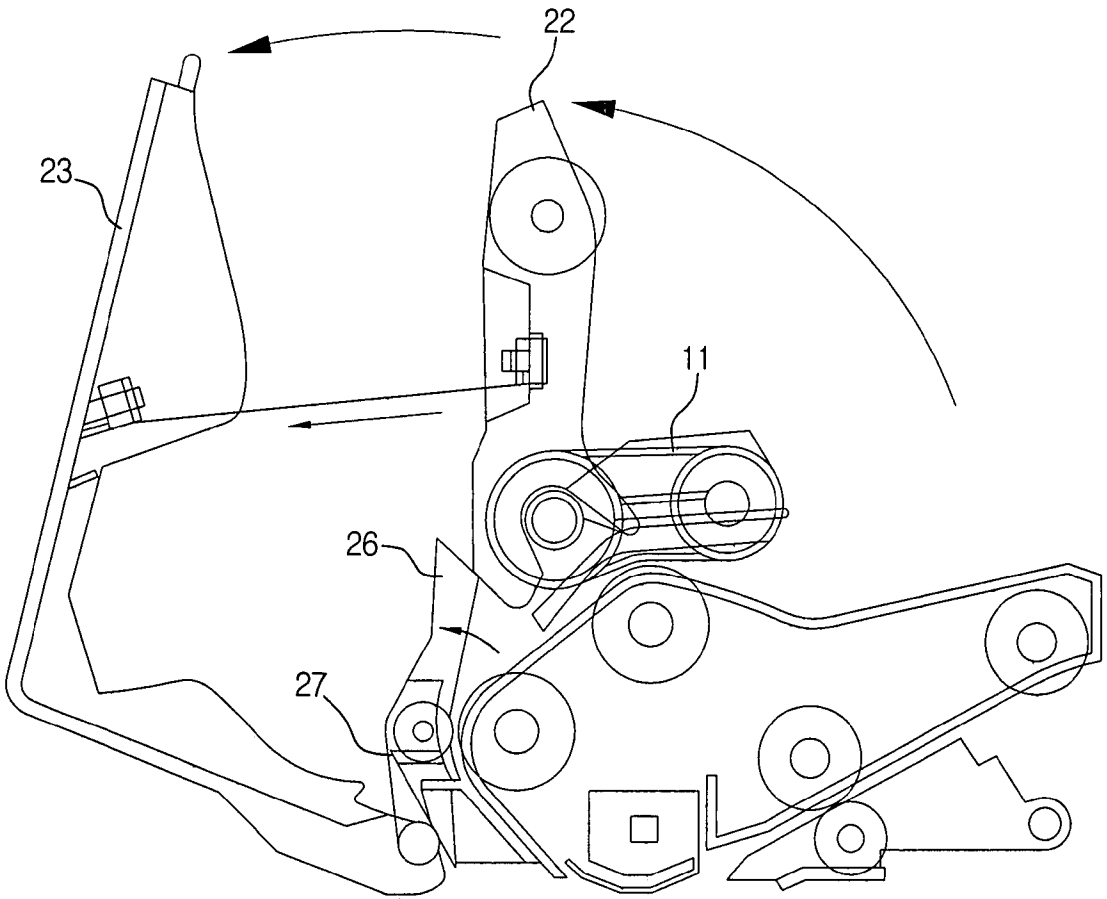
FIG. 2 (PRIOR ART)
FIG. 2 is a schematic view of another conventional automatic document feeder disclosed in JP 2002-265090.
Figure 3:
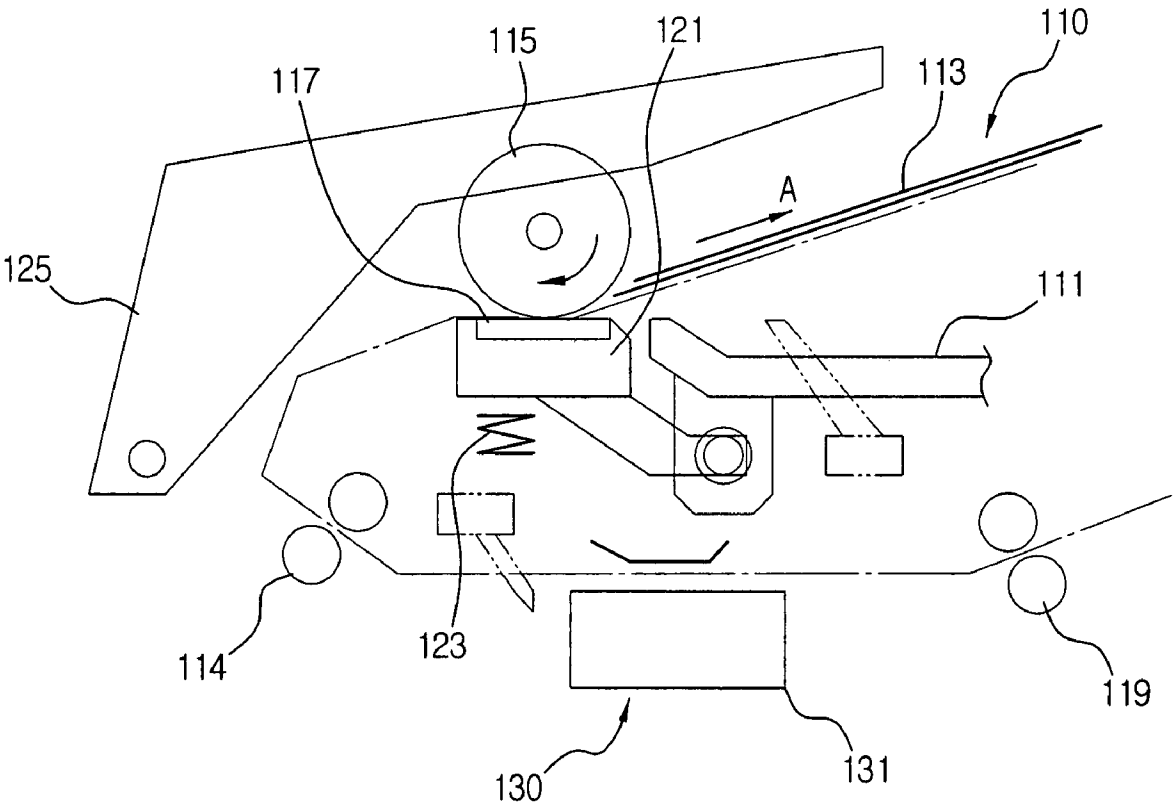
FIG. 3 (PRIOR ART)
FIG. 3 is a schematic view of a part of an image reading apparatus employing a conventional automatic document feeder.
Figure 4:
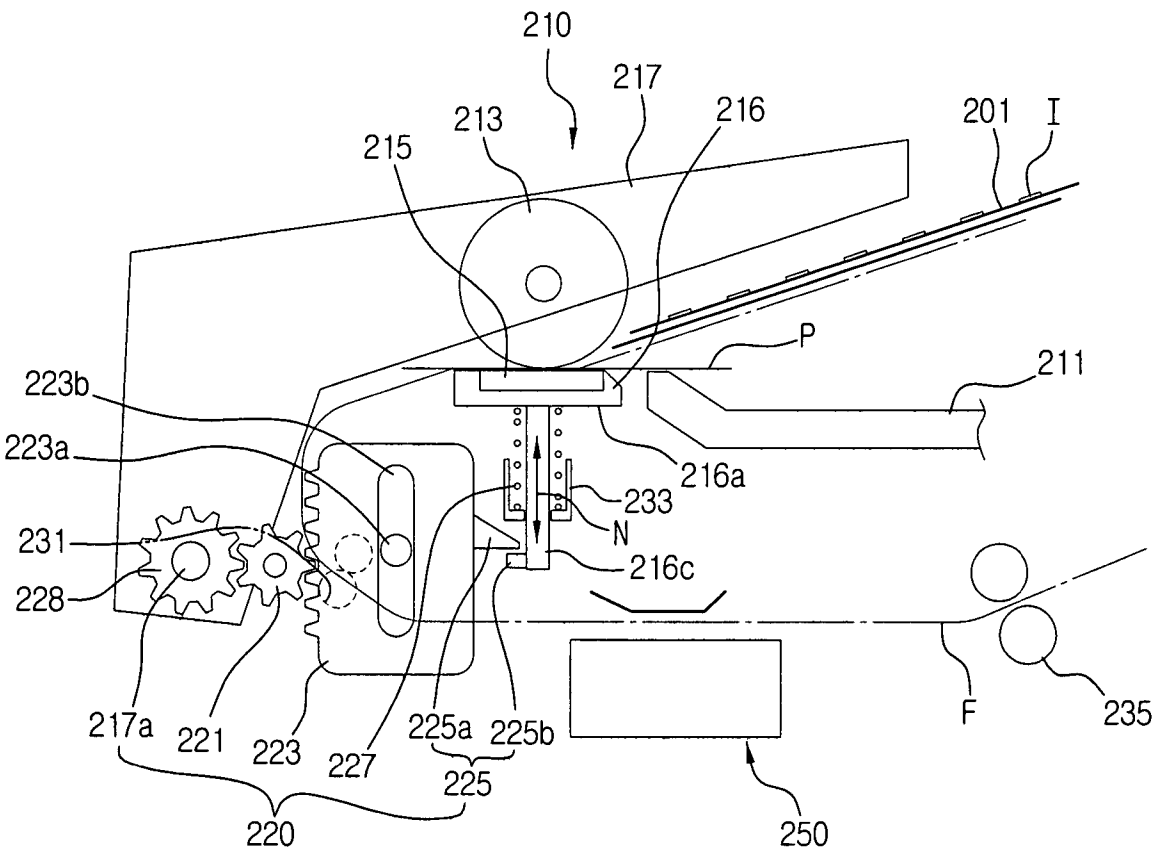
FIG. 4 is a schematic view of an image reading apparatus according to an exemplary embodiment of the present invention.
Figure 5:
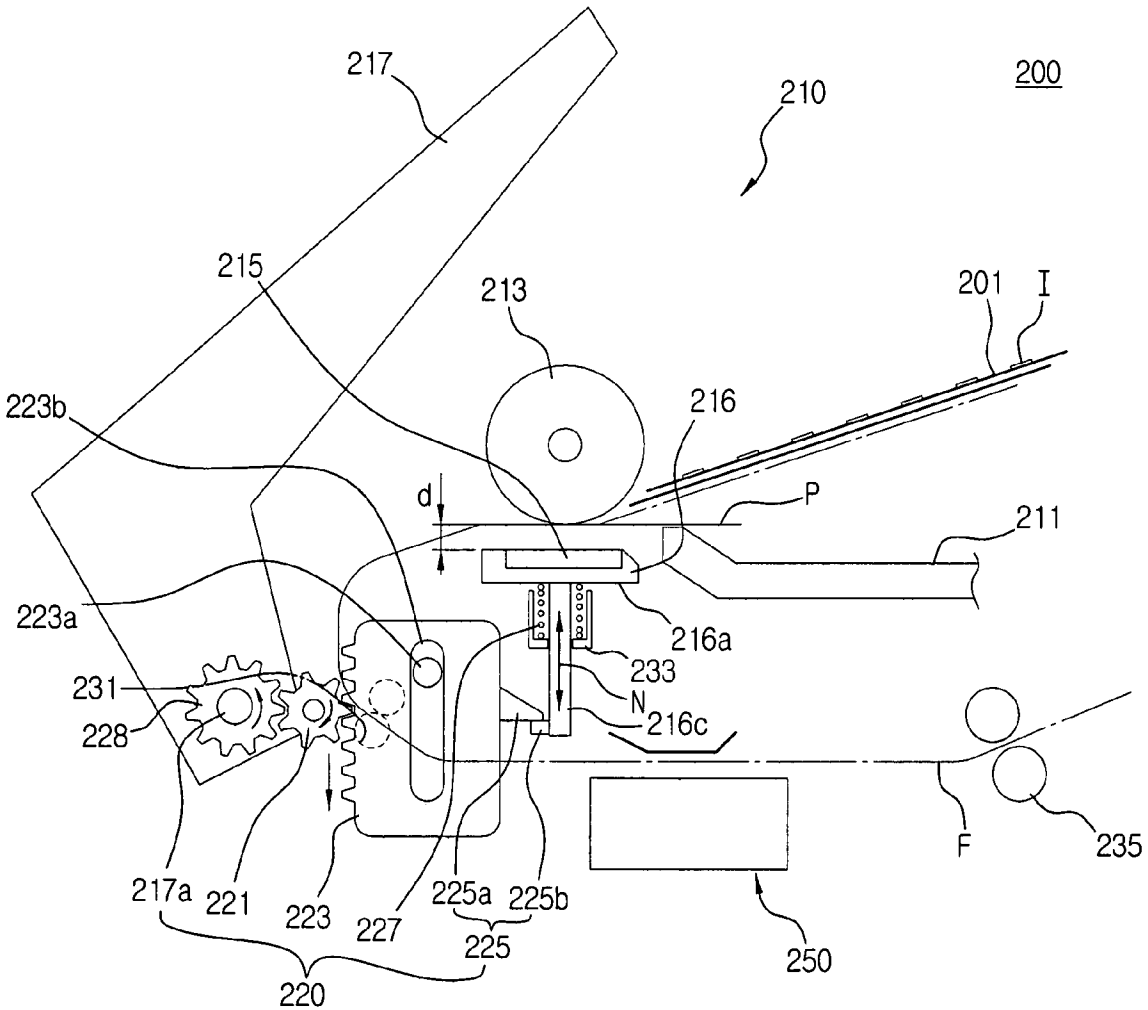
FIG. 5 is a schematic view of the image reading apparatus when a friction pad is separated from a separation roller by an operation of an interlocking unit of FIG. 4.

FIG. 4 is a schematic view of an image reading apparatus according to an exemplary embodiment of the present invention. FIG. 5 is a schematic view of the image reading apparatus when a friction pad is separated from a separation roller by an operation of an interlocking unit of FIG. 4.

Referring to FIGS. 4 and 5, the image reading apparatus 200 includes an automatic document feeder 210 automatically feeding a document 201 and an image reading unit 250 reading an image I of the document 201 supplied through the automatic document feeder 210.

The automatic document feeder 210 includes a document supply tray 211 supplying the document 201. A separation roller 213 separates the document 201 supplied from the document supply tray 211 into individual sheets. A friction pad 215 contacts the separation roller 213 to supply a friction force for separating the document 201. The friction pad 215 is supported by the pad holder 216.

A cover member 217 is capable of opening and closing upwardly and downwardly. An interlocking unit 220 is further formed to contact or separate the friction pad 215 with or from the separation roller 213 in association with the opening and closing of the cover member 217.

The interlocking unit 220 includes a pinion gear 221 rotating according to the opening and closing of the cover member 217. A rack gear 223 rectilinearly moves in a normal N direction to a plane P contacting the separation roller 213 and the friction pad 215 according to the rotation direction of the pinion gear 221. A connecting unit 225 connects the rack gear 223 and the pad holder 216. An elastic member 227 elastically supports the pad holder 216 toward the separation roller 213. The pinion gear 221 is meshed with a driving gear 228 engaged with a rotative shaft 217*a* of the cover member 217 so as to receive a rotative force.

The pad holder 216 includes a pad supporting part 216*a* supporting the friction pad 215 and a stem part 216*c* protruding from a bottom portion of the pad supporting part 216*a*.

The connection unit 225 includes a protruding jaw 225*a* protruding from one side of the rack gear 223 and a locking jaw 225*b* protruding from one side of the stem part 216*c*.

The elastic member 227 may be a coil spring fitting over an outer circumference of the stem part 216*c*. The coil spring, that is, the elastic member 227, is supported by an elastic member holder 233. The elastic member holder 233 may be fixed at a certain position irrespective of the upward and downward movement of the pad holder 216.

The rack gear 223 is supported by the supporting shaft 223*a*, and includes a slit 223*b* in which the supporting shaft 223*a* is inserted and that guides the rectilinear movement of the rack gear 223.

In the image reading apparatus 200, a conveying path F is formed to be substantial C-shaped. On the conveying path F, the document is fed from the automatic document feeder 210 to the image reading unit 250. Accordingly, a conveying roller 231 is formed adjacent to a portion where the conveying path F is u-turned. The conveying roller 231 reverses the document 201 supplied from the document supply tray 211 so that a side with an image I of the document 210 may be faced to the image reading unit 250. Here, the document 201 is loaded in a face up form, in which the side with the image I is faced upwardly, on the document supply tray 211.

The reference numeral 235 denotes a discharge roller discharging the document after the completion of the image reading process.

The operation of removing a jammed paper in the image reading apparatus with the above structure is explained hereinafter.

While the image is being read, the cover member 217 is closed, as shown in FIG. 4. By the elastic force of the elastic member 227, the pad holder 216 is upwardly supported toward a portion where the separation roller 213 is formed so that the friction pad 215 contacts an outer circumference of the separation roller 213 to form a nip. Accordingly, the document 201 supplied from the document supply tray 210 is separated into individual sheets and conveyed by rotation of the separation roller 213. The conveyed document is u-turned and reversed by the conveying roller 231 so that the side with the image I is faced downwardly. The reversed document is conveyed toward the image reading unit 250. After the image is read by the image reading unit 250, the document is discharged by the discharge roller 235.

When a jammed document occurs during the above image reading operation, the cover member 217 is opened as shown in FIG. 5. Then, the driving gear 228 is rotated counterclockwise according to the rotation direction of the cover member 217. Accordingly, the pinion gear 221 is rotated clockwise, and the rack gear 223 meshed with the pinion gear 221, is moved downwardly according to the normal N direction of the plane P contacting the separation roller 213 and the friction pad 215. As the rack gear 223 moves downwardly, the protrusion jaw 225*a* protruding from one side of the rack gear 223 contacts the locking jaw 225*b* protruding from the stem part 216*c* of the pad holder 216 to pressurize the pad holder 216. At this time, the elastic member 227 is locked in the elastic member holder 233 to not move downwardly move and to be compressed.

As described above, the friction pad 215 is distanced from the separation roller 213 by a certain distance d so that a user may easily remove the document held between the separation roller 215 and the friction pad 216.

The structure in which the friction pad 215 may be moved has been explained. Alternatively, the separation roller 213 may be moved.

When the automatic document feeder and the image reading apparatus using the same according to exemplary embodiments of the present invention are applied, the friction pad may be separated from the separation roller as the cover member is opened. Therefore, the jammed document may be easily removed.

Additionally, the structure for removing the jammed document is simple so that manufacturing costs may be reduced.

While the invention has been shown and described with reference to certain embodiments thereof, it will be understood by those skilled in the art that various changes in form and details may be made therein without departing from the spirit and scope of the invention as defined by the appended claims.

What is claimed is:

1. An automatic document feeder, comprising:

a separation roller for separating a document into individual sheets, the document being supplied from a document supply tray;

a friction pad formed to contact the separation roller to supply a friction force for separating the document;

a pad holder supporting the friction pad;

a cover member covering the separation roller; and an interlocking unit pressurizing or separating the pad holder toward or from the separation roller in association with an opening or a closing of the cover member, and the opening or the closing of the cover does not move the document supply tray.

2. The automatic document feeder according to claim 1, wherein the interlocking unit includes a pinion gear rotating in association with the opening or the closing of the cover member;

a rack gear linearly moving in a normal direction to a plane of contact between the separation roller and the friction pad according to a rotation direction of the pinion gear;

a connecting unit connecting the rack gear and the pad holder; and an elastic member elastically supporting the pad holder to face the separation roller.

3. The automatic document feeder according to claim 2, wherein the pad holder includes a pad supporting part supporting the friction pad; and a stem part protruding from a bottom portion of the pad supporting part.

4. The automatic document feeder according to claim 3, wherein the connecting unit includes a protruding jaw protruding from one side of the rack gear; and a locking jaw protruding from one side of the stem part to interfere with the protruding jaw.

5. The automatic document feeder according to claim 3, wherein the elastic member is a coil spring fitting over an outer circumference of the stem part.

6. The automatic document feeder according to claim 5, wherein an elastic member holder supports the coil spring.

7. The automatic document feeder according to claim 6, wherein the elastic member holder is fixed such that the elastic member holder does not move with the stem part.

8. The automatic document feeder according to claim 2, wherein the rack gear is supported by a supporting shaft and has a slit in which the supporting shaft is inserted and that guides rectilinear movement of the rack gear.

9. An image reading apparatus, comprising:

an automatic document feeding unit including at least one document supply tray for supplying a document;

a separation roller for separating the document supplied from the document supply tray into individual sheets;

a friction pad formed to contact the separation roller to supply a friction force for separating the document;

a pad holder supporting the friction pad; and a cover member covering the separation roller and a portion where the friction pad is formed;

an image reading unit for reading an image of the document separated into individual sheets and supplied by the separation roller and the friction pad;

a conveying roller for conveying the document supplied through the automatic document feeding unit toward the image reading unit; and an interlocking unit pressurizing or separating the pad holder toward or from the separation roller in association with an opening or a closing of the cover member, and the opening or the closing of the cover does not move the document supply tray.

10. The apparatus according to claim 9, wherein the interlocking unit includes a pinion gear rotating in association with the opening or the closing of the cover member;

a rack gear linearly moving in a normal direction to a plane of contact between the separation roller and the friction pad according to a rotation direction of the pinion gear;

a connecting unit connecting the rack gear with the pad holder; and an elastic member elastically supporting the pad holder to face the separation roller.

11. The apparatus according to claim 10, wherein the pad holder includes a pad supporting part supporting the friction pad; and a stem part protruding from a bottom portion of the pad supporting part.

12. The apparatus according to claim 11, wherein the connecting unit includes a protruding jaw protruding from one side of the rack gear; and a locking jaw protruding from one side of the stem part to interfere with the protruding jaw.

13. The apparatus according to claim 11, wherein the elastic member is a coil spring fitting over an outer circumference of the stem part.

14. The apparatus according to claim 13, wherein an elastic member holder supports the coil spring.

15. The apparatus according to claim 9, wherein a conveying path of the document is substantially C-shaped between the automatic document feeding unit and the image reading unit.

16. The apparatus according to claim 15, wherein the document supply tray is disposed above the image reading unit; and the document is loaded in a face up position on the document supply tray.

17. The apparatus according to claim 15, wherein the elastic member holder is fixed such that the elastic member holder does not move with the stem part.

18. The apparatus according to claim 10, wherein the rack gear is supported by a supporting shaft and has a slit in which the supporting shaft is inserted and that guides rectilinear movement of the rack gear.

19. An automatic document feeder, comprising:

a separation roller for separating a document into individual sheets, the document being supplied from a document supply tray;

a friction pad formed to contact the separation roller to supply a friction force for separating the document;

a pad holder supporting the friction pad;

a cover member covering the separation roller; and an interlocking unit pressurizing or separating the pad holder toward or from the separation roller in association with an opening or a closing of the cover member, the interlocking unit including a pinion gear rotating in association with the opening or the closing of the cover member;

a rack gear linearly moving in a normal direction to a plane of contact between the separation roller and the friction pad according to a rotation direction of the pinion gear;

a connecting unit connecting the rack gear and the pad holder; and an elastic member elastically supporting the pad holder to face the separation roller.

20. An image reading apparatus, comprising:

an automatic document feeding unit including at least one document supply tray for supplying a document;

a separation roller for separating the document supplied from the document supply tray into individual sheets;

a friction pad formed to contact the separation roller to supply a friction force for separating the document;

a pad holder supporting the friction pad; and a cover member covering the separation roller and a portion where the friction pad is formed;

an image reading unit for reading an image of the document separated into individual sheets and supplied by the separation roller and the friction pad;

a conveying roller for conveying the document supplied through the automatic document feeding unit toward the image reading unit; and an interlocking unit pressurizing or separating the pad holder toward or from the separation roller in association with an opening or a closing of the cover member, the interlocking unit including a pinion gear rotating in association with the opening or the closing of the cover member;

a rack gear linearly moving in a normal direction to a plane of contact between the separation roller and the friction pad according to a rotation direction of the pinion gear;

a connecting unit connecting the rack gear with the pad holder; and an elastic member elastically supporting the pad holder to face the separation roller.

21. An image reading apparatus, comprising:

an automatic document feeding unit including at least one document supply tray for supplying a document;

a separation roller for separating the document supplied from the document supply tray into individual sheets;

a friction pad formed to contact the separation roller to supply a friction force for separating the document;

a pad holder supporting the friction pad; and a cover member covering the separation roller and a portion where the friction pad is formed;

an image reading unit for reading an image of the document separated into individual sheets and supplied by the separation roller and the friction pad;

a conveying roller for conveying the document supplied through the automatic document feeding unit toward the image reading unit, a conveying path of the document being substantially C-shaped between the automatic document feeding unit and the image reading unit; and an interlocking unit pressurizing or separating the pad holder toward or from the separation roller in association with an opening or a closing of the cover member.

* * * * *